US006769996B2

(12) United States Patent
Tseng

(10) Patent No.: US 6,769,996 B2
(45) Date of Patent: Aug. 3, 2004

(54) GOLF CLUB AND A METHOD FOR ASSEMBLING THE GOLF CLUB

(75) Inventor: Wen-Cheng Tseng, 12F-2, No. 275, Sec. 2, Ta-Hsing W. Rd., Taoyuan (TW)

(73) Assignees: Wen-Cheng Tseng, Taoyuan (TW); Kung-Wen Lee, Kaohsiung (TW)

( * ) Notice: Subject to any disclaimer, the term of this patent is extended or adjusted under 35 U.S.C. 154(b) by 0 days.

(21) Appl. No.: 10/337,453

(22) Filed: Jan. 7, 2003

(65) Prior Publication Data

US 2004/0132540 A1 Jul. 8, 2004

(51) Int. Cl.[7] ..... A63B 53/02
(52) U.S. Cl. ..... 473/306; 473/312; 473/345
(58) Field of Search ..... 473/306, 307, 473/305, 312, 298, 299, 295, 288, 345

(56) References Cited

U.S. PATENT DOCUMENTS 5,039,098 A * 8/1991 Pelz ..... 473/306
5,540,435 A * 7/1996 Kawasaki ..... 473/309
5,865,683 A * 2/1999 Yang ..... 473/147
5,931,742 A * 8/1999 Nishimura et al. ..... 473/305

* cited by examiner

*Primary Examiner*—Stephen Blau
(74) *Attorney, Agent, or Firm*—Jackson Walker LLP

(57) ABSTRACT

A golf club has a head with a hollow body. The head has a neck formed at an upper portion of the hollow body. A passage is longitudinally defined through the neck. A flange is formed at a lower end of the neck and inside the hollow body. A first threaded hole is defined through the flange and coaxial with the passage. A bolt is inserted through the first threaded hole. A second threaded hole is defined through a bottom surface of the head and coaxial with the first threaded hole and the passage. A shaft has a lower end inserted in the passage of the neck. A third threaded hole is defined at the lower end and engaged with the bolt.

2 Claims, 6 Drawing Sheets

GOLF CLUB AND A METHOD FOR ASSEMBLING THE GOLF CLUB

BACKGROUND OF THE INVENTION

1. Field of the Invention

The present invention is related to a golf club, and more particularly to a golf club which can be finely adjusted after a dynamic balance test, and a method for assembling the golf club.

2. Description of Related Art

A high-quality golf club must have a good dynamic balance performance. To achieve the dynamic balance, in a conventional process of assembling a golf club, a point is marked on a shaft to show an optimum position, and the gravity of the head is aligned with the point while the head is installed on the shaft. Afterwards, the finished product golf club is processed a test to examine its dynamic balance performance.

However, if the conventional golf club does not have a good dynamic balance performance after testing, it cannot be further adjusted because the head and the shaft have been irreversibly integrated.

Therefore, the invention provides a golf club to mitigate and/or obviate the aforementioned problems.

SUMMARY OF THE INVENTION

The main objective of the invention is to provide a golf club which can be finely adjusted to improve its quality after a dynamic balance test.

Another objective of the invention is to provide a method for assembling the golf club.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
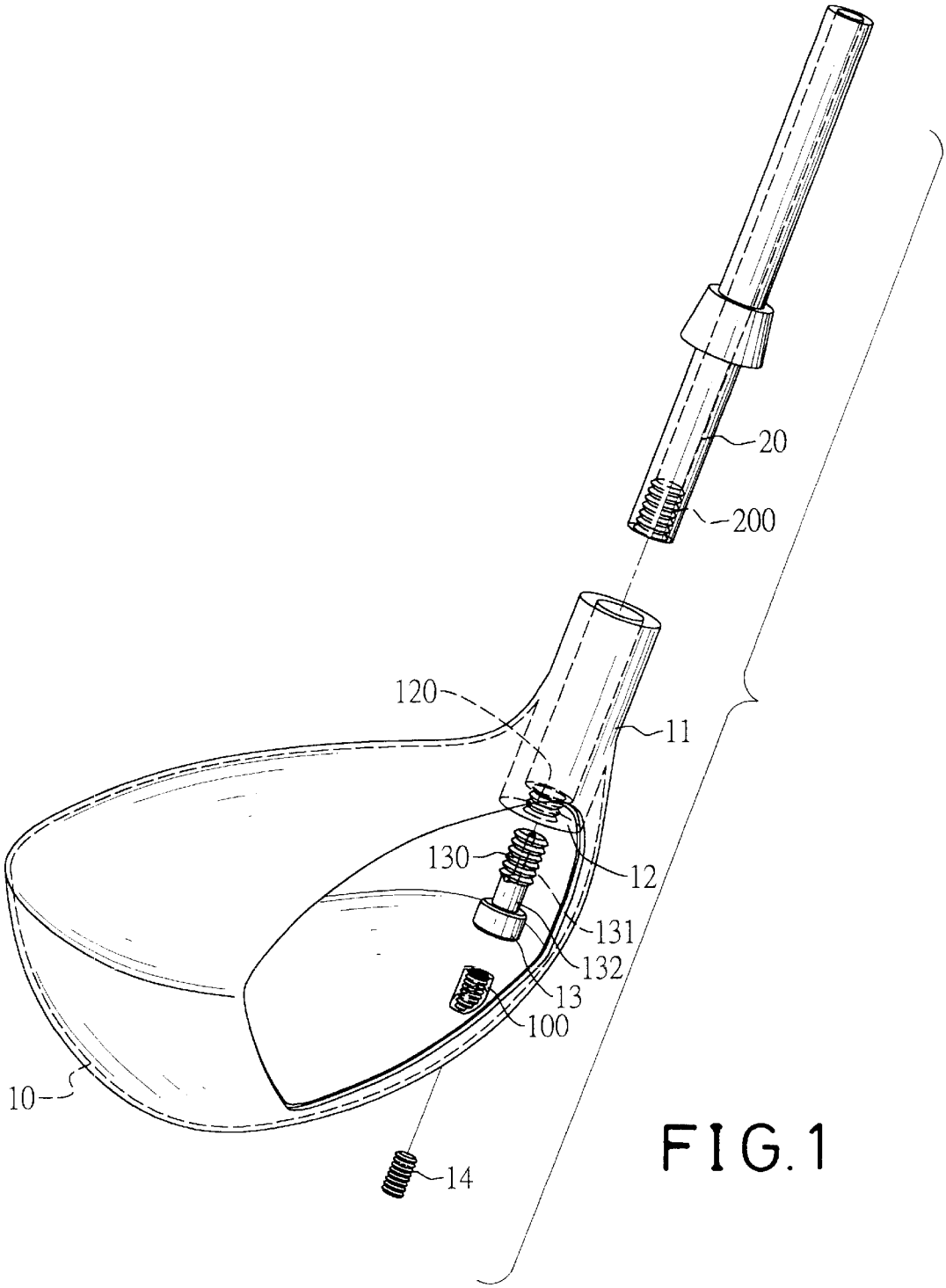
FIG. 1 is an exploded perspective of a golf club in accordance with the invention.
Figure 2:
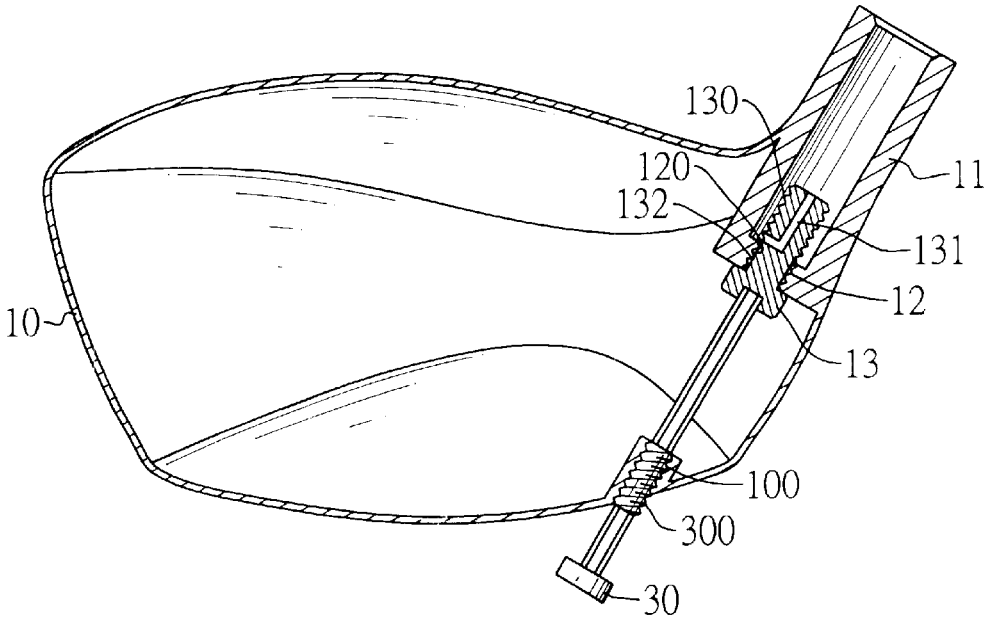
FIG. 2 is a sectional view showing a step of bolt installation of a method for assembling the golf club in accordance with the invention.

Referring to FIGS. 1 and 2, a golf club in accordance with the invention is composed of a head (10) and a shaft (20).

The head (10) has a hollow body (not numbered) and a neck (11) formed at an upper portion of the body. A passage (not numbered) is longitudinally defined through the neck (11) and a flange (12) is formed at a lower portion of the neck (11) and inside the hollow body. A first threaded hole (120) is defined through the flange (12) and coaxial with the passage. A second threaded hole (100) is defined through a bottom surface of the head (10).

A bolt (13) is inserted in the flange (12), and has an external thread (130) formed at a forward end of the bolt (13), and a smooth portion (132) without thread formed behind the external thread (13). An L-like channel (131) is defined through the forward end of the bolt (13). A screw (14) is engaged in the second threaded hole (100).

The shaft (20) has a lower end (not numbered) inserted in the passage of the neck (11), and a third threaded hole (200) is defined in the lower end of the shaft (20). The bolt (13) is engaged in the third threaded hole (200) to fasten the shaft (20) in the neck (11).

A method for assembling the golf club in accordance with the invention substantially includes steps of bolt installation, glue application, shaft installation, dynamic balance test, fine adjustment, and head closing.

Referring to FIG. 2, in a step of bolt installation, the first step to assemble the golf club, the bolt (13) is installed in the first threaded hole (120) of the flange (12) by using an installing tool (30). The installing tool (30) is inserted through the second threaded hole (100), and has a threaded portion (300), which can be engaged with the second threaded hole (100). The bolt (13) is turned by the installing tool (30) to move the external thread (130) over the first threaded hole (120), and the smooth portion (132) of bolt (13) is located in the first threaded hole (120). The bolt (13) is stably pushed by the installing tool (30) and cannot freely move.

Figure 3:
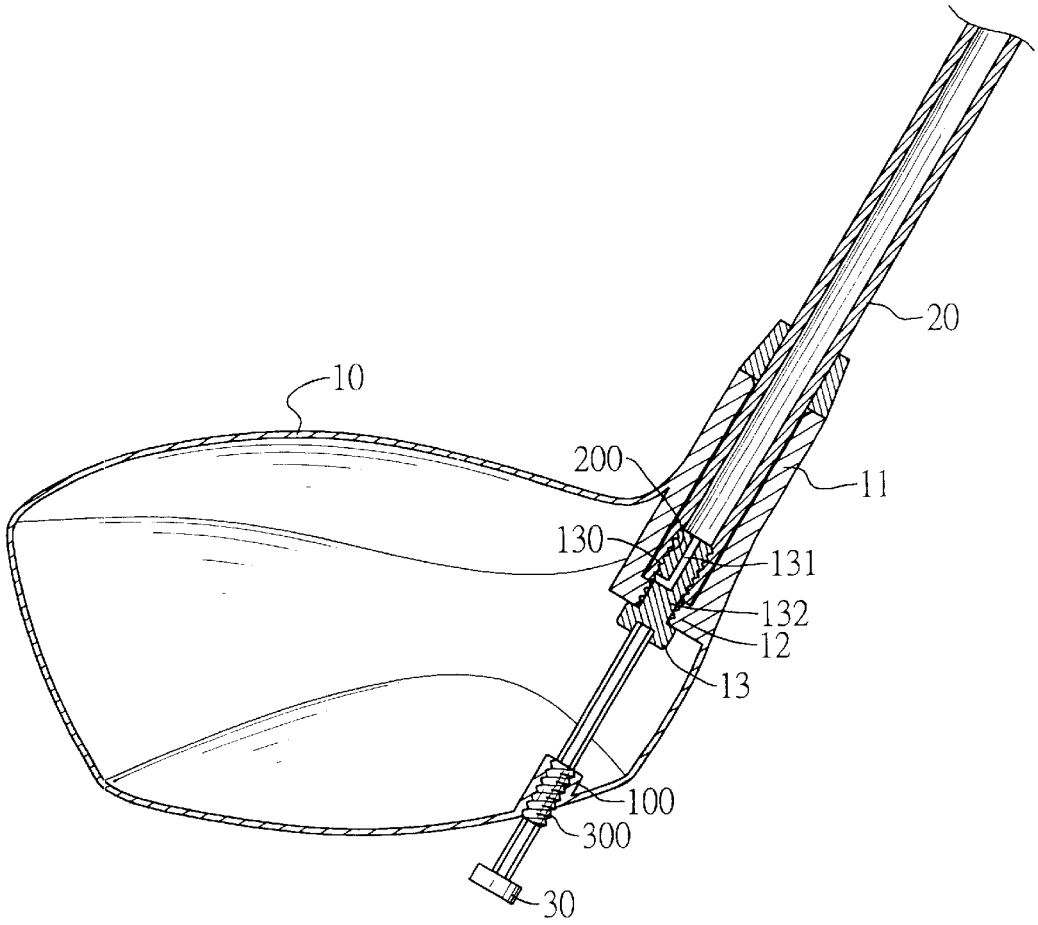
FIG. 3 is a sectional view showing a step of club installation of the method for assembling the golf club in accordance with the invention.

Referring to FIG. 3, after the passage is filled with glue, the shaft (20) is inserted in the neck (11) and engaged with the bolt (13). During the process, the glue around the bolt (13) will be extruded by the shaft (20) through the L-like channel (131) into the shaft (20) and spread between the bolt (13) and the shaft (20) for securely fastening the bolt (13) to the shaft (20). Because the bolt (13) is stably pushed by the installing tool (30), the glue will not leak out from the flange (12).

Afterwards, the installing tool (30) is removed from the head (10), and the head (10) and the shaft (20) are processed in a dynamic balance test.

Figure 4:
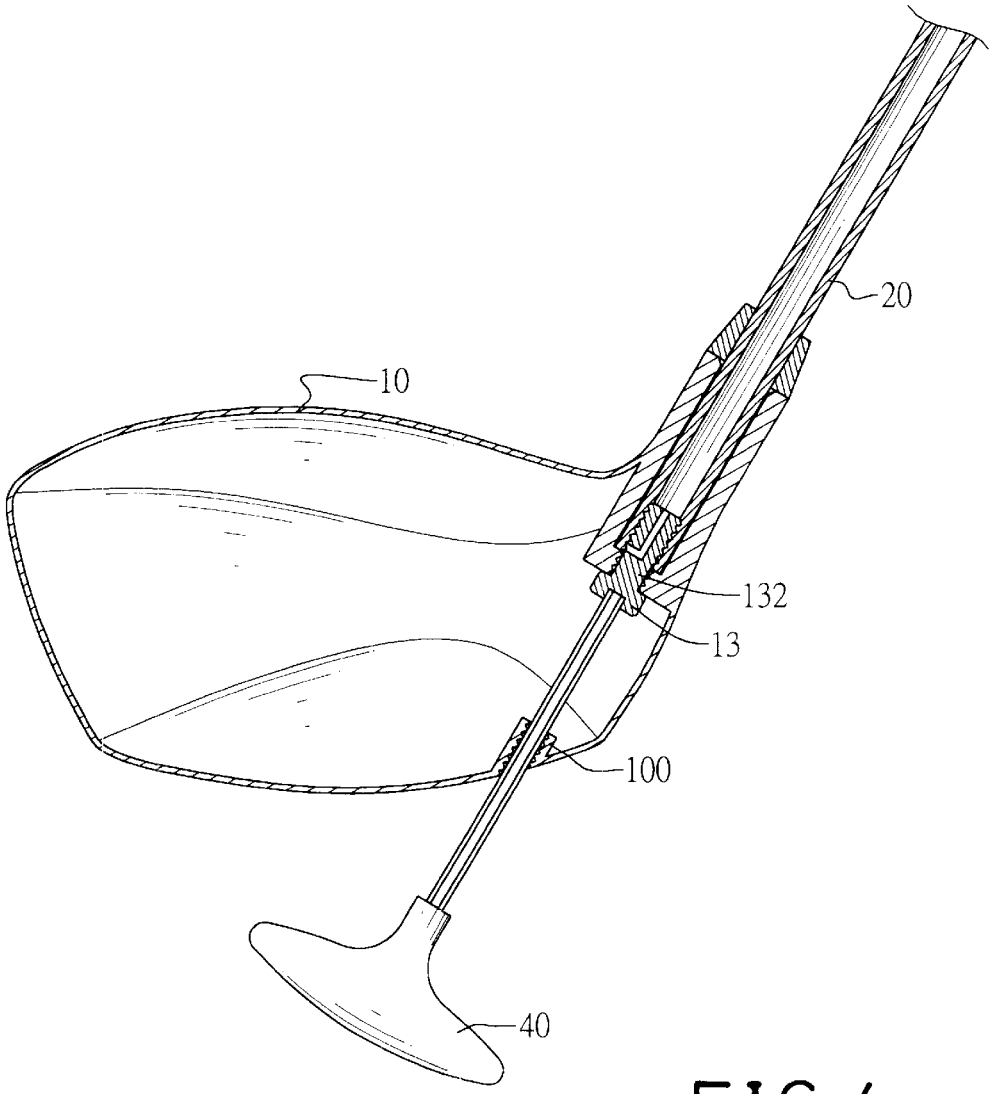
FIG. 4 is a sectional view showing a step of fine adjustment of the method for assembling the golf club in accordance with the invention.

Referring to FIG. 4, after the dynamic balance test is finished and before the glue has solidified, the bolt (13) can be finely adjusted according to the result of the dynamic balance test and tightly engaged with the shaft (20) by an adjusting tool (40) inserted through the second threaded hole (100). Because the smooth portion (132) of the bolt (13) is located in the first threaded hole (120), the external thread (130) of the bolt (13) cannot be engaged with the first threaded hole (120) again and the bolt (13) will not retracted from the flange (12) during the process of fine adjustment.

Figure 5:
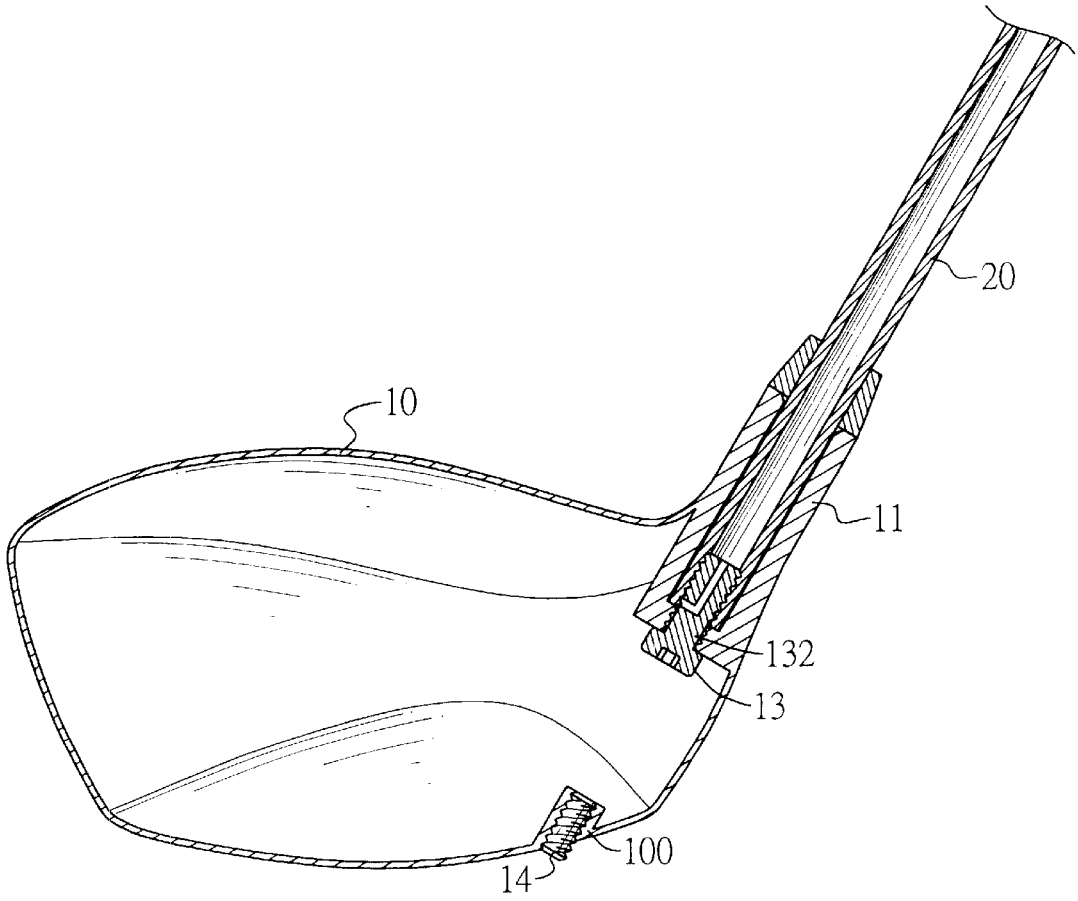
FIG. 5 is a sectional view showing a step of head closing of the method for assembling the golf club in accordance with the invention.

Referring to FIG. 5, after solidification of glue, the screw (14) is engaged in the second threaded hole (100) to close the head (10). A little glue mixed with some metal chips is spread in the second threaded hole (100) so as to securely engage the screw (14) in the threaded hole (100).

Figure 6:
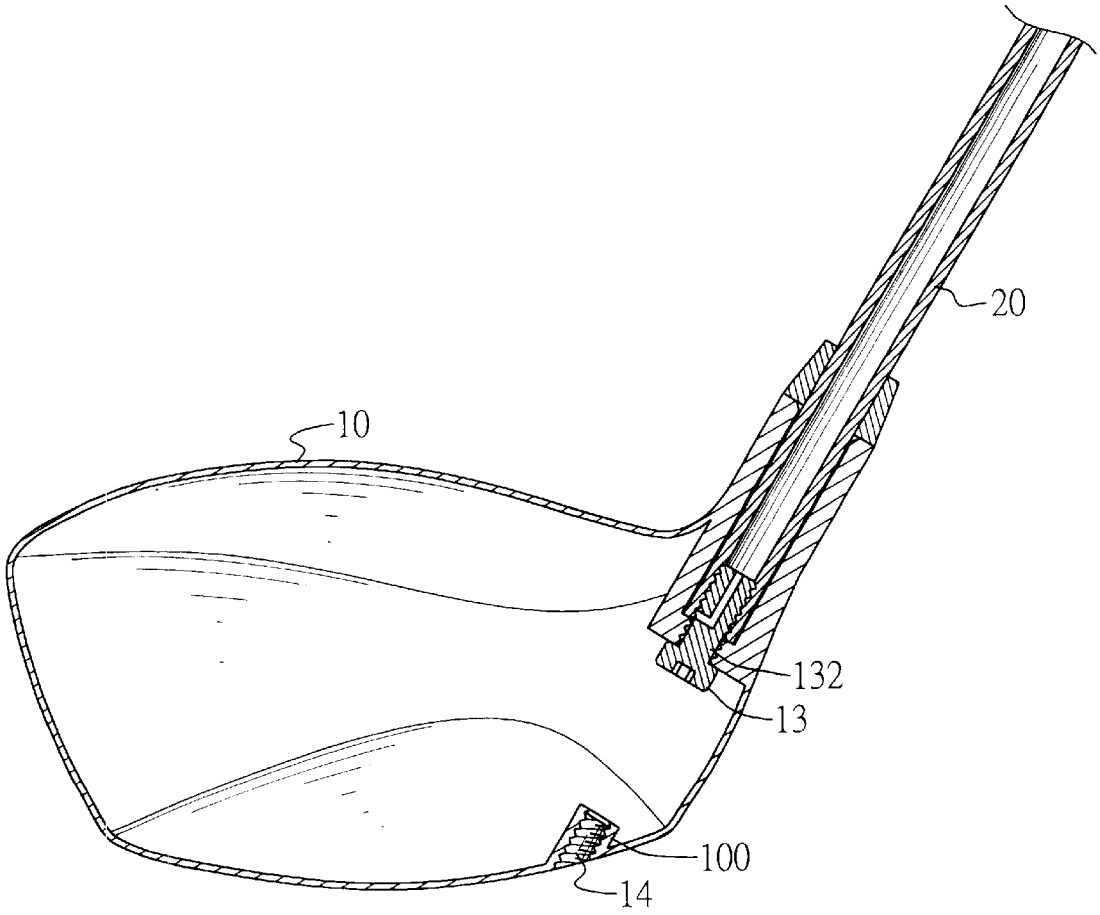
FIG. 6 is a sectional view of the finished golf club in accordance with the invention.

Referring to FIG. 6, finally, a portion of the screw (14) protruded from the bottom surface of the head (10) is removed by means of lathing.

From the above description, it is noted that the invention has the following advantages:

1. The golf club can be finely adjusted to improve its quality after the dynamic balance test.

2. The portion of the screw protruded from the bottom surface of the head is removed, so that the golf club has a favorable appearance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A golf club comprising:

a head having a hollow body with an upper portion and a bottom surface;

a neck formed at the upper portion of the hollow body and having a lower end inside the hollow body, a passage longitudinally defined through the neck, a flange formed at the lower end of the neck inside the hollow body and a first threaded hole defined through the flange and being coaxial with the passage;

a bolt screwed through and held in the first threaded hole and having a forward end, an external thread formed at the forward end, a smooth portion formed behind the external thread and an L-like channel defined through the forward end; and a second threaded hole defined through the bottom surface of the hollow body of the head and being coaxial with the first threaded hole and the passage; and a shaft having a lower end inserted in the passage of the neck and a third threaded hole defined at the lower end;

wherein the external thread of the bolt screws into the third threaded hole of the shaft.

2. The golf club as claimed in claim 1, wherein the external thread of the bolt extends out of the first threaded hole to screw into the third threaded hole of the shaft, and the smooth portion is located in the first threaded hole.

* * * * *